US007553245B2

(12) United States Patent
Dones

(10) Patent No.: US 7,553,245 B2
(45) Date of Patent: Jun. 30, 2009

(54) APPARATUS FOR A BASKETBALL NET FOR DISPLAYING ADVERTISEMENT, MAKING SOUNDS AND CREATING EYE CATCHING VISUAL EFFECTS

(76) Inventor: Nelson C. Dones, 93 Maple St., Croton-Hudson, NY (US) 10520

( * ) Notice: Subject to any disclaimer, the term of this patent is extended or adjusted under 35 U.S.C. 154(b) by 337 days.

(21) Appl. No.: 11/302,669

(22) Filed: Dec. 14, 2005

(65) Prior Publication Data

US 2007/0135238 A1 Jun. 14, 2007

(51) Int. Cl.
*A63B 63/08* (2006.01)

(52) U.S. Cl. ..... 473/485; 473/447; D21/701

(58) Field of Classification Search ..... 473/480, 473/484, 485, 486, 433, 449, 487, 448; D21/702, D21/703, 701, 705
See application file for complete search history.

(56) References Cited

U.S. PATENT DOCUMENTS

| | | | | |
|---|---|---|---|---|
| 2,085,206 | A | 6/1937 | Holmdahl | |
| 2,192,430 | A | 3/1940 | Branner | |
| 2,413,952 | A | 1/1947 | Chervenka | |
| 4,858,920 | A | 8/1989 | Best | |
| 4,877,241 | A * | 10/1989 | Rothbard | 473/485 |
| 5,064,195 | A | 11/1991 | Mcmahan et al. | |
| 5,458,325 | A * | 10/1995 | Klein et al. | 473/485 |
| D397,384 | S * | 8/1998 | DeArmond | D21/701 |
| 6,299,555 | B1 | 10/2001 | Zhao | |
| 6,438,878 | B1 * | 8/2002 | Fine et al. | 40/409 |
| 6,552,831 | B2 * | 4/2003 | Odhner et al. | 359/15 |
| 6,582,329 | B1 | 6/2003 | Cabrera | |
| 7,094,166 | B2 * | 8/2006 | Beane | 473/485 |
| 2004/0144131 | A1 * | 7/2004 | Enevoldsen | 63/3 |
| 2005/0221921 | A1 * | 10/2005 | Beane | 473/485 |

OTHER PUBLICATIONS

International Search Report in International Application No. PCT/US2006/47943, mailed Oct. 12, 2007.

* cited by examiner

*Primary Examiner*—Gene Kim
*Assistant Examiner*—M Chambers
(74) *Attorney, Agent, or Firm*—Stroock & Stroock & Lavan LLP

(57) ABSTRACT

An apparatus on a net of a basketball hoop for displaying advertisement, making sounds and creating eye catching visual effects when a basketball passes through the net, which comprises a plurality of components and a structure for securing the components to the net. The components will make contact with the basketball when the basketball passes through the net.

15 Claims, 3 Drawing Sheets

Fig. 1
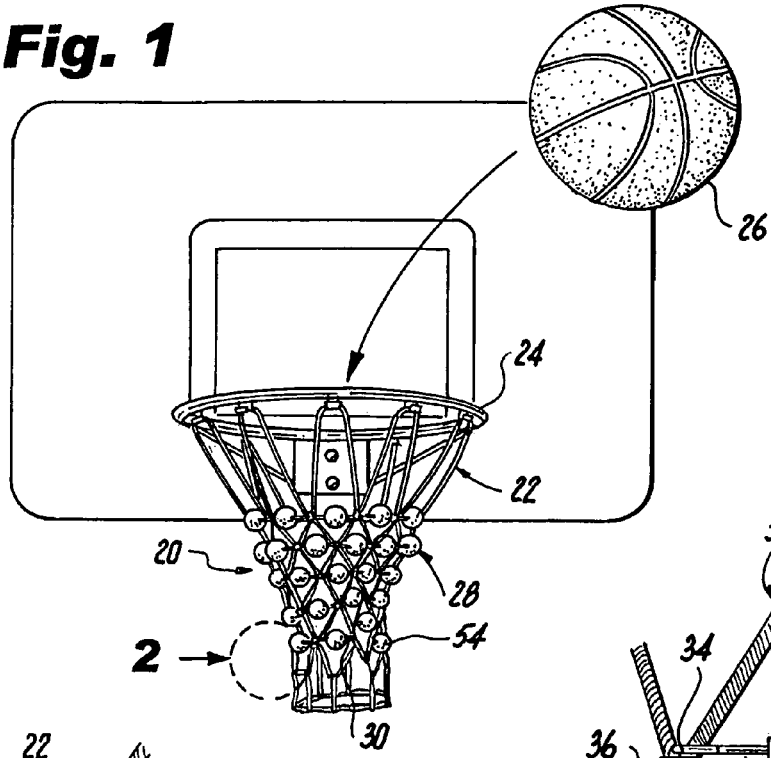
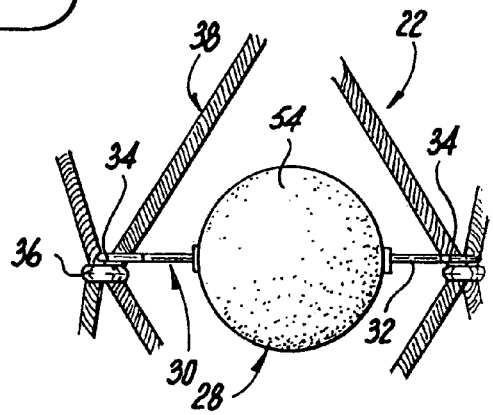
Fig. 2
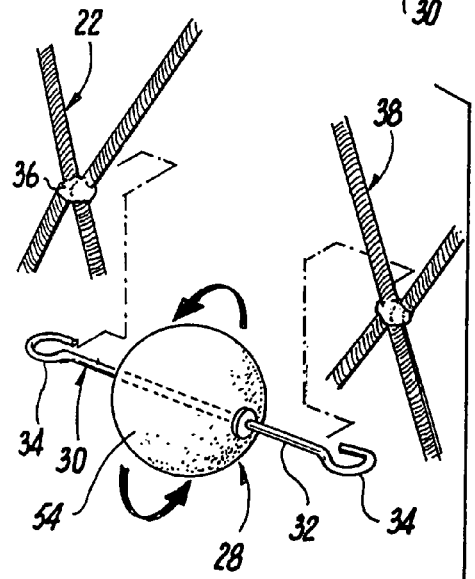
Fig. 3
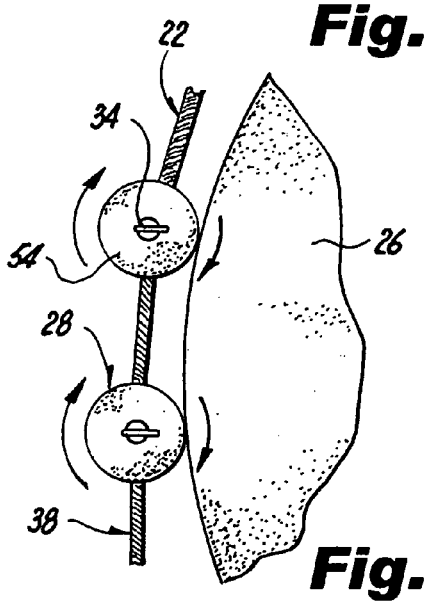
Fig. 4

Fig. 15
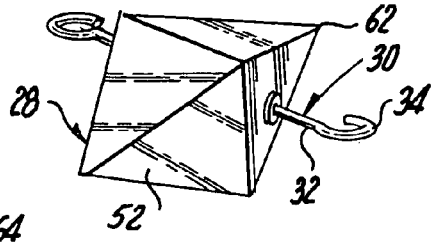
Fig. 5
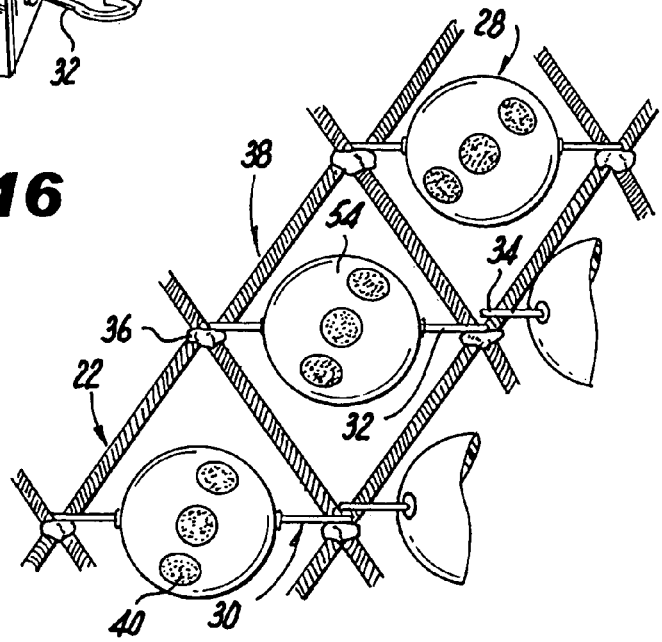
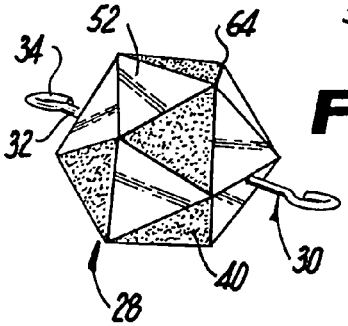
Fig. 16
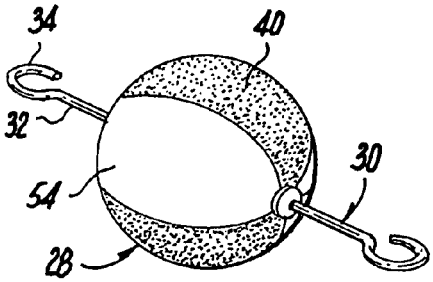
Fig. 6
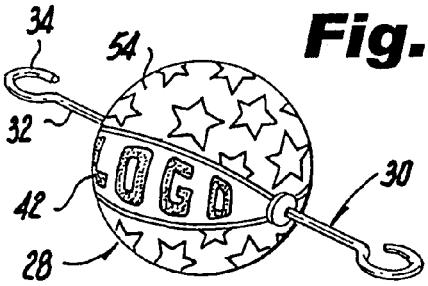
Fig. 7
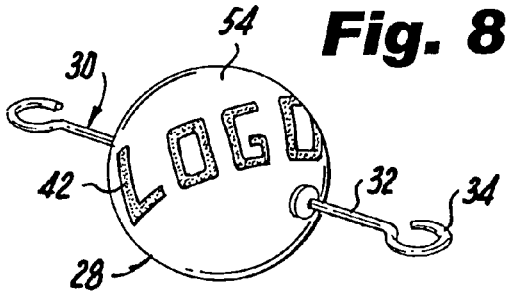
Fig. 8
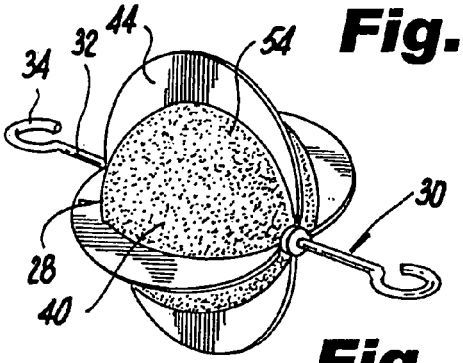
Fig. 9
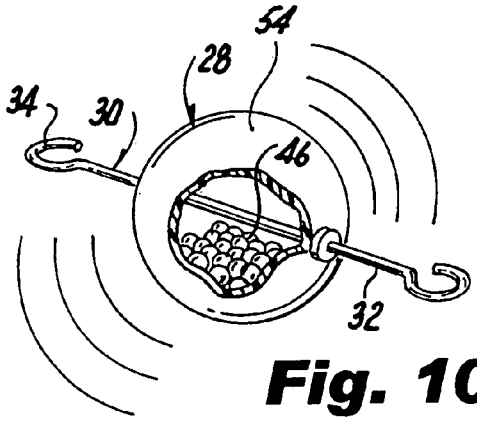
Fig. 10

APPARATUS FOR A BASKETBALL NET FOR DISPLAYING ADVERTISEMENT, MAKING SOUNDS AND CREATING EYE CATCHING VISUAL EFFECTS

BACKGROUND OF THE INVENTION

1. Field of the Invention

The present invention relates to a basketball goal, and more particularly, an apparatus on a net of a basketball hoop for displaying advertisement, making sounds and creating eye catching visual effects when a basketball passes through the net.

2. Description of the Prior Art

Numerous innovations for basketball devices have been provided in the prior art that will be described. Even though these innovations may be suitable for the specific individual purposes to which they address, however, they differ from the present invention.

A FIRST EXAMPLE, U.S. Pat. No. 2,085,206 to Holmdahl teaches a basketball basket support, comprising an inverted U-shaped member adapted for hooking over the upper edge of a door or the like, a ring having a pair of prongs, the U-shaped member having a pair of sockets to receive the prongs, a pair of projections on the U-shaped member engaging the ring to prevent lateral movement thereof relative to the U-shaped member and a basketball basket suspended from the ring.

A SECOND EXAMPLE, U.S. Pat. No. 2,192,430 to Branner teaches a device comprising a support having a front wall, the support and front wall being formed from an integral plate of material, means associated with the front wall only comprising a register, the means consisting of a stud member rotatively mounted on the front wall, a dial represented on the face of the front wall, the stud being disposed centrally of the dial, a pointer rigidly secured to the stud and adapted to cooperate in indicatory manner with the dial, a ratchet wheel rigidly attached to the stud on the rear face of the front wall and spaced from the wall by means of a plurality of circumferentially spaced rounded projections provided on the ratchet wheel, an actuating lever having a hooked portion adapted to cooperate with the teeth of the ratchet wheel, the actuating lever having an angle portion provided with a slot, the rear face of the front wall being provided with a stud member engaging the slot to limit the motion of the actuating lever, the actuating lever being biased in one direction of its motion by spring means attached thereto and connected to the support, a check pawl engaging the ratchet wheel, the check pawl being also attached to the rear face of the front wall and a member secured to the actuating lever whereby the lever may be moved to rotate the ratchet wheel to cause the pointer to traverse the dial.

A THIRD EXAMPLE, U.S. Pat. No. 2,413,952 to Chervenka teaches a self-recording basketball goal comprising, in combination, a basketball goal having a depending net, an annular non-extensible member suspended from the net having a plurality of series connected switches mounted therein and adapted to be actuated when a basketball passes through the net, and electrically actuated signaling means connected through the switches to a suitable source of electrical current and adapted to emit a signal when the switches are simultaneously closed.

A FOURTH EXAMPLE, U.S. Pat. No. 4,858,920 to Best teaches a score-sensitive basketball hoop apparatus for sensing then announcing the by-passage of a basketball through the hoop. The sensor comprises a transmitting light and a photoelectric cell. When a ball passes through the hoop the transmitted beam of light is broken. A broken beam is detected and the by-passage of the ball through the hoop is signalled by lights fixed to the hoop and the score is registered on a scoreboard.

A FIFTH EXAMPLE, U.S. Pat. No. 5,064,195 to McMahan, et al. teaches a novelty basketball goal producing a predetermined pattern of sound effects, such as crowd cheers and applause, responsive to a made shot. The goal includes a force activated sensor suspended within the net of the goal by the wires which connect the sensor to the sound effects generating means. The sensor will contact an object passing through the hoop thereby triggering the sound effects generator. The sensor is preferably a self-contained electrical switch having a housing and two conductors positioned therein. One of the conductors is suspended within the housing so that a force applied thereto causes the conductors of the switch to come into electrical contact. A inexpensive and readily manufactured novelty basketball goal with sound effects is provided by the simple force activated sensing arrangement. The backboard of the goal may include a clip-for mounting to a vertical surface, such as the rim of a waste paper basket. The hoop may also be pivotally connected to the backboard so that the hoop may be folded against the backboard to facilitate storage and carrying of the goal.

A SIXTH EXAMPLE, U.S. Pat. No. 6,299,555 B1 to Zhao teaches a basketball goal sounding apparatus which comprises an elastic cord, a trigger, conducting wires, a switch of power supply and a audio device properly connected to each other. The trigger comprises a hollow insulating tube, a metal spring placed in the hollow insulating tube and two metal plates with conductive contact fixed to the ends of the metal spring respectively. Each end of the elastic cord is extended to the respective end of hollow insulating tube and fixed to the respective plate. One end of the conducting wires is fixed to the inner wall of the hollow insulating tube, the other end of the wires is connected to the switch of power supply and the audio device. The present invention is simple in structure and easy to be implemented, and is helpful for the judgement of whether a shot is made, and for increasing the friendly atmosphere of the game.

A SEVENTH EXAMPLE, U.S. Pat. No. 6,582,329 B1 to Cabrera teaches a hoop for indicating when a basketball passes therethrough that includes a ring and first and second apparatuses. In a first embodiment, the first apparatus includes a momentary microswitch, a lever that closes the microswitch when contacted by the basketball, and a timer that activates when the momentary switch is closed. In a second embodiment, the first apparatus includes a light source and a photo electric cell that receives a beam of light from the light source. When the beam of light is broken by the basketball, the photo electric cell activates and activates the timer. The second apparatus includes an internal ring, a plurality of bulbs removably mounted in, and illuminating through, the internal ring when the timer is activated, a plurality of tube assemblies that depend from, and visually communicate with, the internal ring, a speaker, and an annunciator that audiblizes through the speaker when the timer is activated.

It is apparent now that numerous innovations for basketball devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an apparatus on a net of a basketball hoop for displaying advertisement, making sounds and creating eye catching visual effects when a basketball passes through the net that avoids the disadvantages of the prior art.

ANOTHER OBJECT of the present invention is to provide an apparatus on a net of a basketball hoop for displaying advertisement, making sounds and creating eye catching visual effects when a basketball passes through the net that is simple and inexpensive to manufacture.

STILL ANOTHER OBJECT of the present invention is to provide an apparatus on a net of a basketball hoop for displaying advertisement, making sounds and creating eye catching visual effects when a basketball passes through the net that is simple to use.

BRIEFLY STATED, STILL YET ANOTHER OBJECT of the present invention is to provide an apparatus on a net of a basketball hoop for displaying advertisement, making sounds and creating eye catching visual effects when a basketball passes through the net which comprises a plurality of components and a structure for securing the components to the net. The components will make contact with the basketball when the basketball passes through the net.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 1 is a diagrammatic perspective view, showing the present invention in use, being an apparatus on a net of a basketball hoop for displaying advertisement, making sounds and creating eye catching visual effects when a basketball passes through the net;

FIG. 2 is an enlarged diagrammatic elevational view, of the area enclosed in the dotted circle indicated by arrow 2 in FIG. 1, showing one spherical shaped member of the present invention in greater detail;

FIG. 3 is a diagrammatic exploded perspective view, showing the spherical shaped member being removed from the net;

FIG. 4 is a diagrammatic elevational view, with parts broken away, showing how a basketball going through the net causes the spherical shaped members to rotate;

FIG. 5 is a diagrammatic elevational view of a portion of a net, showing the spherical shaped members in greater detail;

FIGS. 6, 7, 8 and 9 are diagrammatic perspective views, showing the spherical shaped members of the present invention with a variety of indicia, advertisement and decorations thereon;

FIG. 10 is a diagrammatic perspective view of a spherical member with parts broken away, showing noise making pellets therein;

FIG. 15 is a perspective view, showing an octahedron shaped member;

FIG. 16 is a diagrammatic perspective view, showing an icosahedron shaped member.

A MARSHALLING OF REFERENCE NUMERALS UTILIZED IN THE DRAWING

Figure 11:
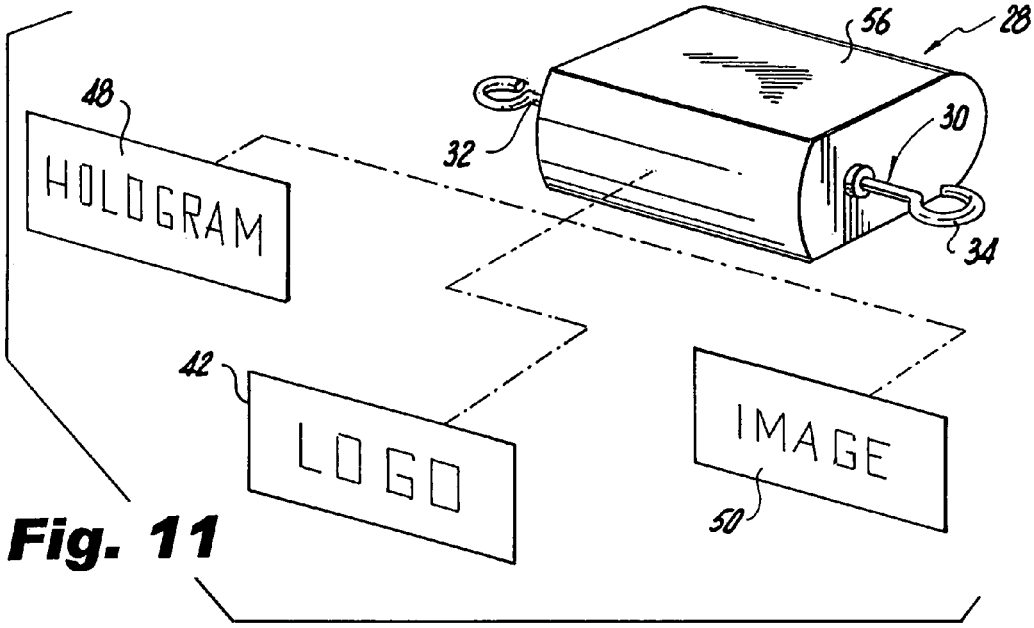
FIG. 11 is a diagrammatic exploded perspective view, showing a random shaped member which could have a hologram, a logo or a decorative image incorporated thereon.

20 apparatus
22 net
24 basketball hoop
26 basketball
28 component of apparatus 20
30 securing structure of apparatus 20
32 shaft of securing structure 30
34 hook on shaft 32
36 connection of web portion 38
38 web portion of net 22
40 pattern on component 28
42 logo on component 28
44 decoration on component 28
46 pellet in component 28
48 hologram on component 28
50 decorative image on component 28
52 mirrored surface on component 28
54 spherical shaped member for component 28
56 random shaped member for component 28
58 cube shaped member for component 28
60 dodecahedron shaped member for component 28
62 octahedron shaped member for component 28
64 icosahedron shaped member for component 28
66 chain of securing structure 30
68 chime member for component 28

DETAILED DESCRIPTION OF THE PREFERRED EMBODIMENT

Referring now to FIGS. 1 through 17, in which like numerals indicate like parts, the present invention is an apparatus 20 on a net 22 of a basketball hoop 24 for displaying advertisement, making sounds and creating eye catching visual effects when a basketball 26 passes through the net 22. The apparatus 20 consists of a plurality of components 28. A structure 30 is for securing each of the components 28 to the net 22. The components 28 will make contact with the basketball 26 when the basketball 26 passes through the net 22.

The securing structure 30, as shown in FIGS. 2 through 16, includes a plurality of shafts 32. Each shaft 32 extends through one component 28, with a hook 34 formed at each end of the shaft 32. Each hook 34 engages with a connection 36 of a web portion 38 of the net 22, whereby the shafts 32 holding the components 28 will extend horizontally on the net 28, so that the components 28 will rotate when the basketball 26 passes through the net 22.

As shown in FIGS. 5, 6, 9 and 16, each component 28 can include at least one pattern 40 thereon. When the components 28 rotate on the shafts 32, the at least one pattern 40 will create eye catching visual effects. The at least one pattern 40 can be of a specific color to enhance the eye catching visual effects.

As shown in FIGS. 7, 8 and 11, each component 28 can include at least one logo 42 thereon. When the components 28 rotate on the shafts 32, the at least one logo 42 will display an advertisement. As shown in FIG. 9, each component 28 can include decorations 44 thereon. When the components 28 rotate on the shafts 32, the decorations 44 will create eye catching visual effects.

FIG. 10 shows the component 28 hollow and includes a plurality of pellets 46 therein, so that when the components 28 rotate on the shafts 32, the pellets 46 will make sounds. In FIG. 11, each component 28 can include at least one hologram 48 incorporated thereon, so that when the components 28 rotate on the shafts 32, the at least one hologram 48 will create eye catching visual effects. Each component 28 can also contain at least one decorative image 50 incorporated thereon, so that when the components 28 rotate on the shafts 32, the at least one decorative image 50 will create eye catching visual effects. Each component 28, as shown in FIGS. 12 through 16, includes at least one mirrored surface 52 incorporated thereon, so that when the components 28 rotate on the shaft 32, the at least one mirrored surface 52 will create eye catching visual effects.

Figure 13:
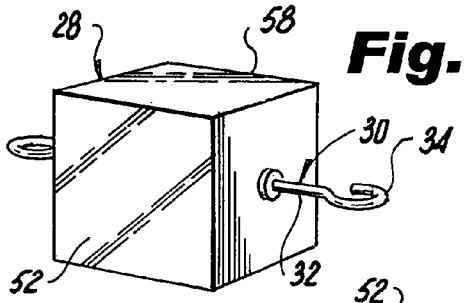
FIG. 13 is a diagrammatic perspective view, showing a cube shaped member.
Figure 12:
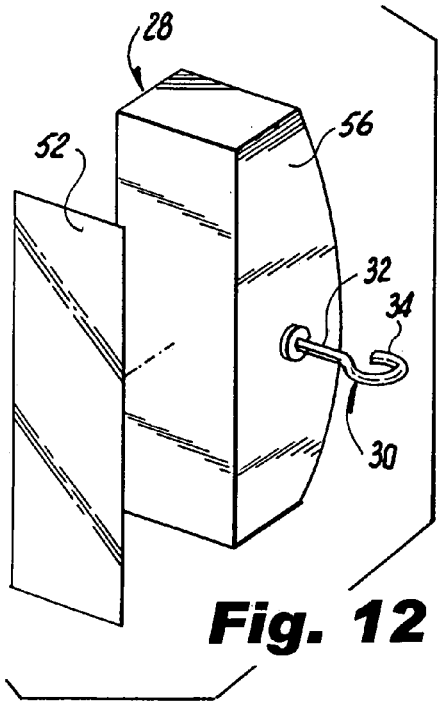
FIG. 12 is a random shaped member having a least one mirrored surface incorporated thereon.
Figure 14:
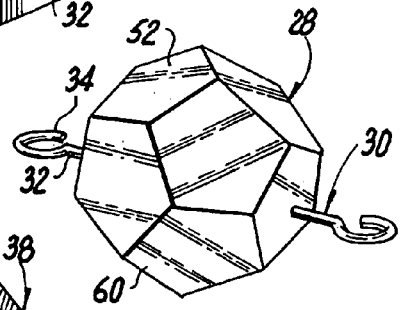
FIG. 14 is a perspective view, showing a dodecahedron shaped member.

In FIGS. 1 through 10, the component 28 is shown as a spherical shaped member 54. In FIGS. 11 and 12, the component 28 is shown as a random shaped member 56. In FIG. 13, the component 28 is shown as a cube shaped member 58. In FIG. 14, the component 28 is shown as a dodecahedron shaped member 60. In FIG. 15 the component 28 is shown as an octahedron shaped member 62. In FIG. 16 the component 28 is shown as an icosahedron shaped member 64.

Figure 17:
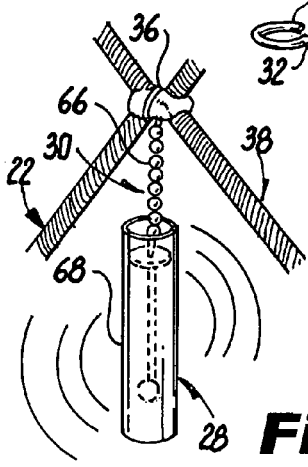
FIG. 17 is a diagrammatic perspective view, showing a chime member suspended from the net.

The securing structure 30 can be a plurality of chains 66. In FIG. 17, the chain 66 is affixed at a first end and extends vertically from one connection 36 of a web portion 38 of the net 22. A second end of the chain 66 is connected to one component 28, so that the components 28 will shake when the basketball 26 passes through the net 22. Each component 28 is a chime member 68, so that the chime member 68 will make sounds when it shakes.

It will be understood that each of the elements described above, or two or more together, may also find a useful application in other types of constructions differing from the types described above.

While the invention has been illustrated and described as embodied in an apparatus on a net of a basketball hoop for displaying advertisement, making sounds and creating eye catching visual effects when a basketball passes through the net, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An apparatus for attachment to a net of a basketball hoop for receiving a basketball, the hoop defining a plane, the apparatus comprising: one or more components; one or more shafts, wherein each component is connected to a corresponding shaft, such that the component rotates about the corresponding shaft, each shaft including a securing member for removably attaching the components to the net, and wherein when attached to the net, the components are positioned to make contact with the basketball when the basketball passes through the net; and wherein the shafts are substantially parallel to the plane of the basketball hoop wherein said each of the securing members further comprise a hook formed at an end of the one or more shafts, wherein the hook engages with a connection of a web portion of the net, whereby the one or more shafts connected to the component will extend horizontally on the net, so that the component will rotate when the basketball passes through the net.

2. The apparatus as recited in claim 1, wherein each said component includes at least one pattern thereon, so that when said components rotate on said shafts, said at least one pattern will create eye catching visual effects.

3. The apparatus as recited in claim 2, wherein said at least one pattern is of a specific color to enhance the eye catching visual effects.

4. The apparatus as recited in claim 1, wherein each said component includes at least one logo thereon, so that when said components rotate on said shafts, said at least one logo will display an advertisement.

5. The apparatus as recited in claim 1, wherein each said component includes decorations thereon, so that when said components rotate on said shafts, said decorations will create eye catching visual effects.

6. The apparatus as recited in claim 1, wherein each said component is hollow and includes a plurality of pellets therein, so that when said components rotate on said shafts, said pellets will make sounds.

7. The apparatus as recited in claim 1, wherein each said component includes at least one hologram incorporated thereon, so that when said components rotate on said shafts, said at least one hologram, will create eye catching visual effects.

8. The apparatus as recited in claim 1, wherein each said component includes at least one decorative image incorporated thereon, so that when said components rotate on said shafts, said at least one decorative image will create eye catching visual effects.

9. The apparatus as recited in claim 1, wherein each said component includes at least one mirrored surface incorporated thereon, so that when said components rotate on said shaft, said at least one mirrored surface will create eye catching visual effects.

10. The apparatus as recited in claim 1, wherein the component is a spherical shaped member.

11. The apparatus as recited in claim 1, wherein each said component is a random shaped member.

12. The apparatus as recited in claim 1, wherein each said component is a cube shaped member.

13. The apparatus as recited in claim 1, wherein each said component is a dodecahedron shaped member.

14. The apparatus as recited in claim 1, wherein each said component is an octahedron shaped member.

15. The apparatus as recited in claim 1, wherein each said component is an icosahedron shaped member.

* * * * *